United States Patent [19]

Backman et al.

[11] 4,319,684

[45] Mar. 16, 1982

[54] PACKING, METHOD FOR ITS MANUFACTURE AND MEANS FOR CARRYING OUT SAID METHOD OF MANUFACTURE IN PRACTICE

[75] Inventors: Erik E. Backman, Gothenburg; Ulf A. Henrekson; Inge L. Nertman, both of Kungälv, all of Sweden

[73] Assignee: Aktiebolaget Volvo, Sweden

[21] Appl. No.: 55,428

[22] Filed: Jul. 6, 1979

[30] Foreign Application Priority Data

Jul. 7, 1978 [SE] Sweden ..... 7807628

[51] Int. Cl.[3] ..... B65D 73/00

[52] U.S. Cl. ..... 206/464; 206/467; 206/470; 53/396

[58] Field of Search ..... 206/461, 462, 463, 464, 206/465, 467, 470; 53/3

[56] References Cited

U.S. PATENT DOCUMENTS

| | | | |
|---|---|---|---|
| 2,618,383 | 11/1952 | Chapman et al. | 206/461 |
| 2,850,160 | 9/1958 | Siebel et al. | 206/464 |
| 3,463,309 | 8/1969 | Szostek | 206/470 |
| 3,730,739 | 5/1973 | Seiferth et al. | 206/461 |
| 3,780,856 | 12/1973 | Braverman | 206/461 |
| 3,835,224 | 9/1974 | Peters | 206/467 |
| 4,091,927 | 5/1978 | Lunsford | 206/467 |

FOREIGN PATENT DOCUMENTS

| | | | |
|---|---|---|---|
| 1280053 | 11/1961 | France | 206/463 |
| 1427915 | 1/1966 | France | 206/464 |

*Primary Examiner*—Joseph Man-Fu Moy
*Attorney, Agent, or Firm*—Steele, Gould & Fried

[57] ABSTRACT

A resealable package, comprising: a first, transparent member having a receptacle portion, a brim around the receptacle portion and structure forming one part of a snap-in lock formed in the brim; a second, flat member substantially co-extensive with the foldably connected to the transparent member along an edge of the brim opposite the snap-in lock structure, the second member having structure forming the other part of the snap-in lock, the first and second members being thereby detachably connectable; and, a removable sheet member, large enough to at least correspond in size to the first and second members and of relatively stiff material, interposed everywhere between the first and second members for reinforcing both the receptacle portion and the brim, the removable member having an opening through which only a portion of only the snap-in lock structure projects, whereby the members are held securely but releasably together.

The method is characterized by providing a number of first and second members in rows and removable stiffening sheets in rows, which can be folded and filled together, and thereafter separated into individual packages.

12 Claims, 7 Drawing Figures

PACKING, METHOD FOR ITS MANUFACTURE AND MEANS FOR CARRYING OUT SAID METHOD OF MANUFACTURE IN PRACTICE

BACKGROUND OF THE INVENTION

1. Field of the Invention

This invention relates to packages in which small components can be displayed and sold, and in particular, those packages which are resealable and reusable.

2. Prior Art

It is known to provide packings or packages in the form of a generally transparent plastic container attached to a piece of cardboard for small articles or sets of articles. Such packings, which are called blister packs, have proved to be of advantage because the piece of cardboard can be used for information and advertisements and at the same time the articles are held safely enclosed in the plastic container, where they can be observed without having to open up the packing, i.e. if the plastic material is transparent. A variety of methods have been used to join the plastic container to the piece of cardboard. Thus, the container can for example be fastened by means of stitching with staples. Another method employed involves glueing the receptacle to the piece of cardboard with a cold or heat-setting glue.

Both the known methods for joining the plastic container to the piece of cardboard as well as variants thereof exhibit disadvantages in connection with the manufacture as well as application. Thus, stapling and simple glueing methods are not reasonable because the use of heat-setting glues requires an expensive equipment. In their application said methods imply that the packing cannot be opened without being destroyed. It is however true that a packing put together by means of staples can be opened by breaking open the staples, but this is indeed complicated and would not be practical in a shop, for example, if it is desired to inspect the packaged article more closely. It will probably be out of the question to open up a gummed or glued packing without its being destroyed. In certain cases it can be an advantage that the article is not accessible without destroying the packing, but in other cases it is desirable or necessary that the article is accessible in order to permit its being tried on or tested. In the case of the latter the packing must not suffer any damage, so that blister packs may not be used for such articles.

SUMMARY OF THE INVENTION

It is an object of the present invention to provide a packing which exhibits all the advantages of a blister pack but is easy to open up and reseal without being damaged.

It is another object of the invention to provide a packing which facilitates automatic article insertion and sealing.

It is also an object of the invention to provide a simplified and less expensive method for the manufacture of the packing.

It is still another object of the invention to provide a means for carrying out the manufacturing method in practice, which means is of simple and logical design.

The objects of the invention are obtained by providing the packing with a sheet of preferably stiff and untransparent material, as cardboard, which extends between the brim and said portion from the one edge connected to said portion over the opening of the container and past the snap-in lock, the sheet being provided with an opening through which the male part is arranged to extend so that the sheet is securely held as a result of the engagement between the male part and the opening.

The method is characterized by providing a number of first and second members in rows and removable stiffening sheets in rows, which can be folded and filled together, and thereafter separated into individual packages.

BRIEF DESCRIPTION OF THE DRAWINGS

An embodiment of the packing according to the invention is illustrated in the accompanying drawings, which also show an embodiment of the means for the manufacture of the packing and illustrate the method of manufacture.

Figure 1:
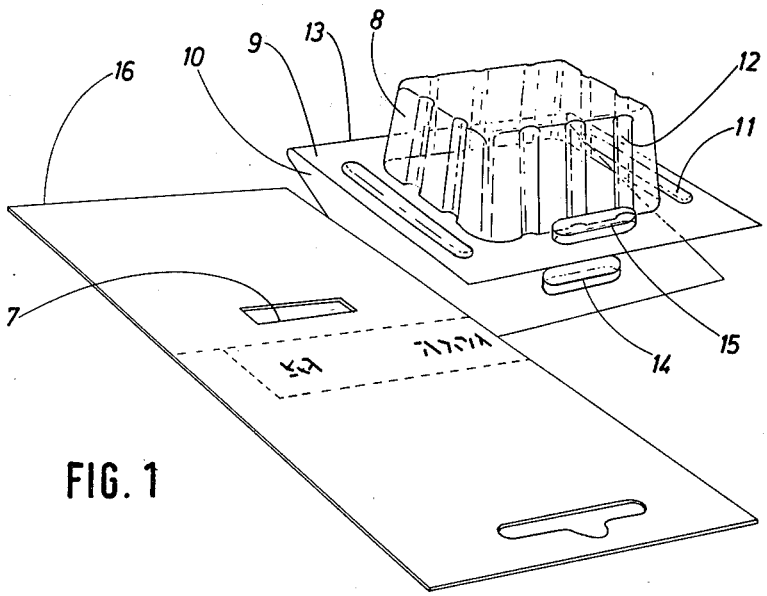
FIG. 1 is a perspective view of two details, which constitute the packing.
Figure 2:
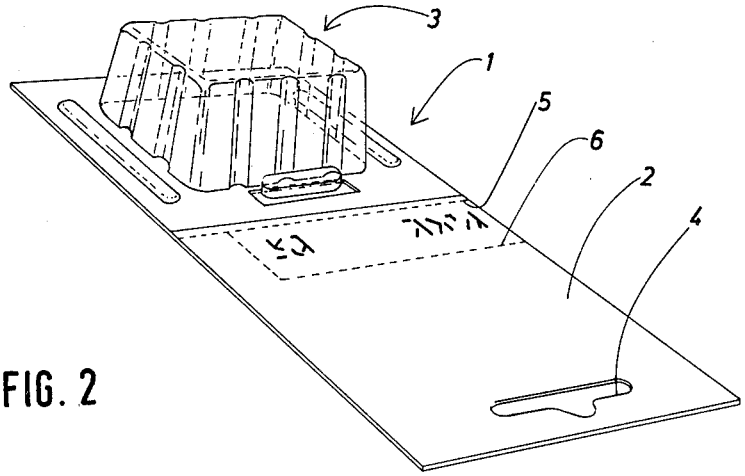
FIG. 2 shows the finished packing in a perspective view.

According to FIG. 2 a blister pack or package 1 is formed by a piece of cardboard 2, to which a transparent plastic part 3 is fastened, which forms a transparent container, into which one or several articles can be inserted. The piece of cardboard 2 can provide information, and it is provided with a hole 4 for the suspension of the package on a storage or sales rack. The cardboard 2 is also provided with a perforation rule 5, located very close to the extreme end of the plastic part 3, and a perforation rule 6, exhibiting an angular bend, by means of which perforations the outer portion of the cardboard can be torn off completely from the remaining portion, which is co-extensive with plastic part 3. At the same time a small part can be detached, viz. the portion between the perforation rules 5 and 6. This part can form a label. As is moreover evident from FIG. 1, the cardboard 2 is in addition provided with an opening 7 located within the area co-extensive with the plastic part 3.

The plastic part 3 can be seen more exactly in FIG. 1, which shows the cardboard 2 and the plastic part 3 in separated condition. One portion of plastic part 3 is formed with a container portion 8 and a brim 9. The other portion is a bottom portion 10, which can be folded inwards against the brim 9. The brim 9 and the receptacle 8 are provided with embossed reinforcing relieves 11 and 12 respectively. The bottom portion 10, which is connected along one of its edges with the brim 9 in a hinge forming fold 13, carries at its opposite free edge an embossed portion projecting out from the brim 9, referred to as the male part 14. The brim carries an embossed portion projecting away from the bottom portion, referred to as the female part 15. The male part 14 and the female part 15 are located right in front of each other and together form a snap-in lock, which will be described later.

In the assembled condition of the packing, which is shown in FIG. 2, the edge 16 of the cardboard 2 is pushed up against the hinge fold 12, and the brim 9 of the plastic part 3 and the bottom portion 10 are connected with each other by means of the snap-in lock formed by the male part 14 and the female part 15, whereby the male part 14 penetrates through the opening 7 of the cardboard 2. The cardboard is thereby locked in a predetermined position to the plastic part 3. The snap-in lock 14, 15 is held together with such a force that the packing is kept closed in a secure manner, but in such a manner that it can be opened up and relocked in the same secure manner without any damage either to the cardboard or to the plastic part 3.

In the presently preferred embodiment the method of manufacture comprises the following steps:

1. Production of the cardboard blank which constitutes a multiple of the piece of cardboard 2. The cardboard blank is designated 17 in FIG. 3. The cardboard blank has two free edges 18 and 19 respectively, the edge 18 of the finished piece of cardboard being intended to form the edge 16 (FIG. 1) and the edge 19 being intended to form the edge opposing the edge 16. The cardboard blank 17 shall have the same width as the distance from the edge 16 to the opposing edge of the piece of cardboard 2, whereas the length is a multiple of the width of the piece of cardboard 2.

2. Providing the cardboard blank 17 with the desired printing, which is repeated as many times as the number of cardboard pieces 2 contained in the blank. In a corresponding manner the cardboard blank is provided with openings corresponding to the openings 4 and 7 of the finished piece of cardboard 2 and perforation rules corresponding to the perforation rules 5 and 6.

Figure 3:
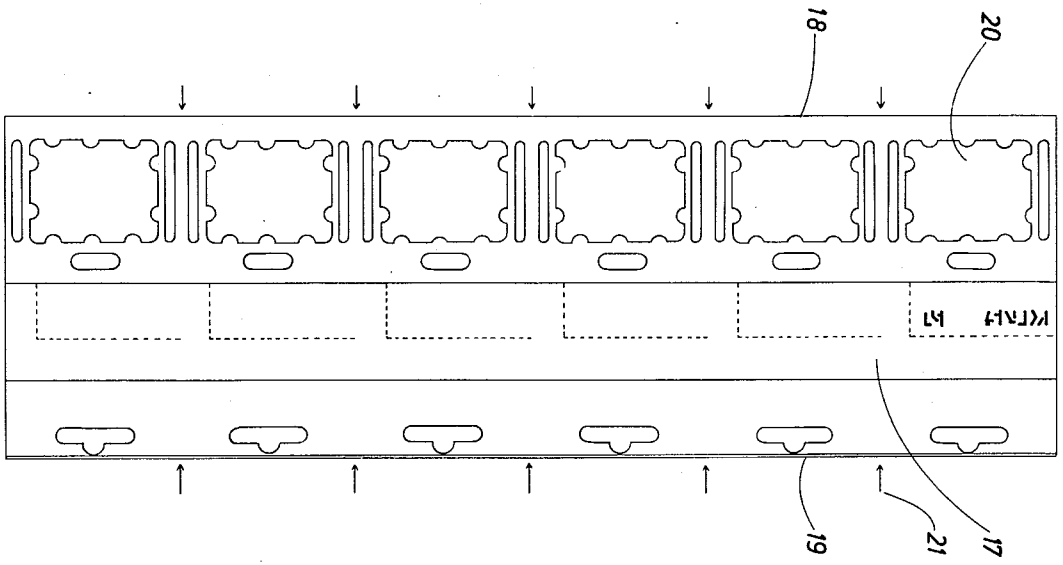
FIG. 3 is a view of the packing in a stage of its manufacture.

3. Preparation of a plastic blank, which in FIG. 3 is designated 20. As was the case with the cardboard blank 17, the plastic blank 20 forms an uninterrupted row of the finished detail, viz. the plastic part 3, the details of which are repeated in the number of plastic parts, which can be contained in the blank 20. Both the blanks 17 and 20 are of equal length. The preparation of the plastic blank 20 can be made from a plastic sheet employing vacuum forming or hot die-pressing techniques, but it is also possible to use the injection moulding process. The plastic blank is provided with a fold corresponding to the fold 13 of the finished plastic part or a fractural kerf in the form of a perforation for the same purpose.

4. Insertion of the plastic blank 20, in open condition, into a packing and locking apparatus. Those portions of the blank which in the finished plastic part constitute the brim 9 and the bottom portion 10 are folded away from each other, with the portions of the blank which form the containers 8 having their interior facing upwards.

5. Filling of the receptacle portions of the blank with the articles intended to be packed.

6. Insertion of the cardboard blank with the edge 18 facing the fold or fractural kerf of the plastic blank and centered with respect to the plastic blank.

7. Closing of the plastic blank by folding the brim 9 and the bottom portion 10 against each other with the cardboard blank located therebetween, and by means of the apparatus inserting the row of male parts 14 in the row of corresponding female parts 15. The plastic blank 20 is thereby locked on top of the cardboard blank 17 and is fastened to the same because the male parts 14 are located in the corresponding openings 7 of the cardboard blank.

8. Removal of the sealed packing blank comprising the cardboard and plastic blank and insertion of the packing blank in an apparatus, by means of which the blank is divided up in individual packings. This takes place by cuts at a distance corresponding to the width of the finished packing, whereby a number of finished packings are obtained from the blank, such packings being shown in FIG. 2.

In the finished closed packing blank illustrated in FIG. 3 a length corresponding to six finished packings has been chosen. The blank is divided up at the arrows indicated with 21, whereby six equal finished packings are formed.

As should have been evident from the description of the method of manufacture, the means for carrying out the same comprises two apparatuses invented for said purpose, viz. the packing and locking apparatus and the cutting apparatus. Equipment for preparing the cardboard and plastic blanks, already known in the art, is also necessary.

Figure 4:
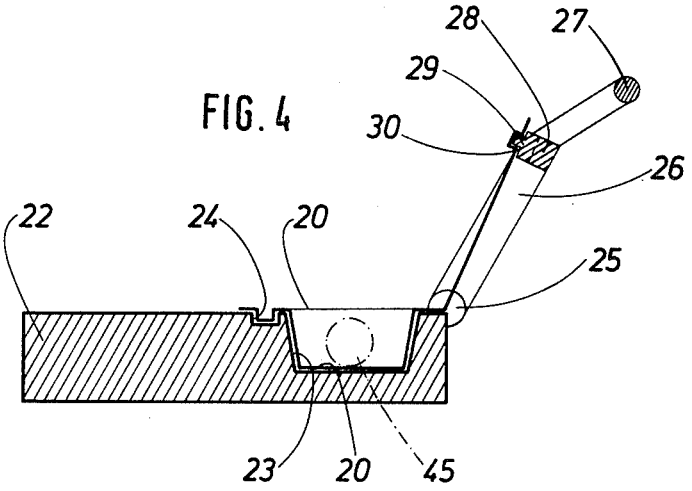
FIGS. 4–6 show cross-sectional views of the means for the manufacture of the packing as seen in three different working positions, illustrating the method.
Figure 5:
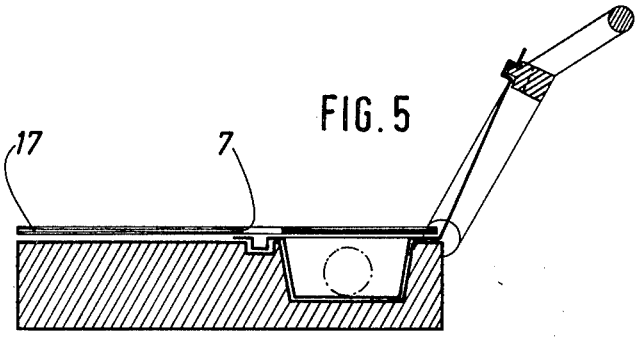
Figure 6:
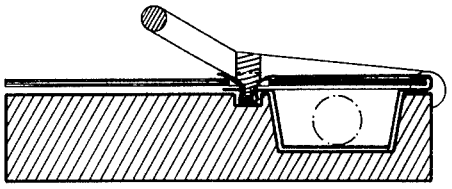

The apparatus for packing and sealing is shown in FIGS. 4–6 in different positions of use. It comprises a foot plate 22 with a number of recesses 23, which correspond in size to the container 8 of the plastic part 3, and the number of which corresponds to the number of containers 8 of the plastic blank 20. There are moreover recesses 24 in the plate, which correspond to the female parts 15 of the plastic blank 20. Right in front of each recess 23 there is thus a recess 24. The recesses 24 have a depth which is slightly less than the height of the female parts 15 above the brim 9 of the plastic part 3.

At each one of the ends of the foot plate 22 there is a pivot-bearing 25, said pivot-bearings being placed along a common center line, which is approximately in line with the edge 18 of the plastic blank, when the plastic blank is placed in the apparatus. A lever 26 extends from each one of the bearings, said two levers being connected by means of two longitudinal stays, which form a handle 27 placed at the extreme end of the levers 26 and a pressure bar 28 positioned inside of the handle 27. The pressure bar 28 bears a number of projecting pins 29. The pins 29 are right in front of the recesses 24, and when the levers 26 are lowered down into the position illustrated in FIG. 6, the pins 29 penetrate into the recesses 24. When a plastic blank 20 is inserted into the apparatus in the manner shown in the figures with its receptacles 8 in the recesses 23, then the pins 29 will be inside the male parts 14. The pins 29 are somewhat shorter than the common depth for the male part 14 and the female part 15 and terminate in a dog portion 30.

Figure 7:
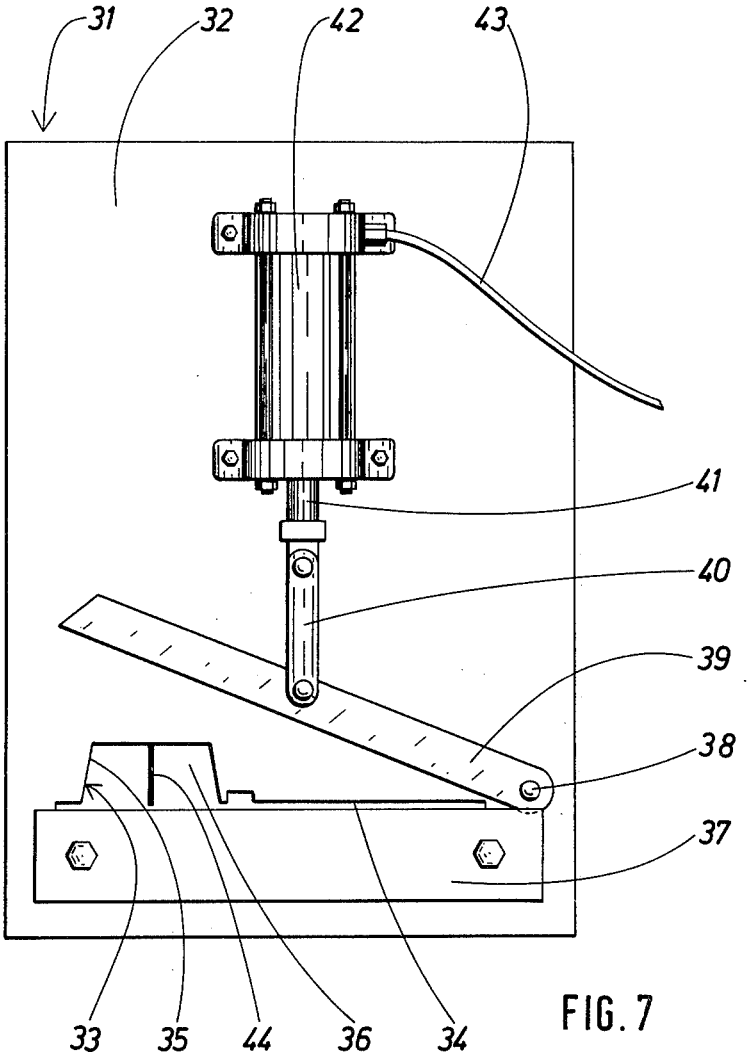
FIG. 7 finally shows an additional part of the means for manufacture.

The cutting apparatus, as shown in FIG. 7, which forms part of the means according to the invention, comprises a housing 31, which exhibits a plate 32 with an upwards facing surface. An opening 33 extends through the plate 32, the profile of which opening is adapted to the profile of the packing illustrated in FIG. 2. Thus, the opening exhibits a slit 34 and a projecting part 35 of larger dimension, so that the cardboard 2 of the packing and the plastic part 3 with the container 8 respectively can pass through. The housing continues under the plate and at its bottom terminates in a plate 36, which can be seen through the opening 33.

Along the opening 33 of the plate 32 a knife 37 is mounted in fixed position, and close to this knife another knife 39, which is pivotable, is journalled on a shaft 38. The knives 37 and 38 form a cutting tool, the cutting plane of which is in the same plane as the underside of the knife 37 and the top side of the knife 39. Thus, the knife 39 is mounted at a certain distance above the plate 32. The distance between said cutting plane and the plate 36 is equal to the width of a packing, thus equal to the distance between two dividing lines 21 (FIG. 3).

By means of a pivotably journalled link 40 the knife 39 is connected with the piston rod 41 of a pneumatic power means 42, which is attached to the plate 32. The pneumatic power means 42 is connected with a source of compressed air by means of a hose 43 and a control device.

The control device for the pneumatic power means 42 comprises a release valve (not shown), which is attached to the plate 36, and which is actuated by means of a sensor organ 44 projecting under the opening 35. The control device is arranged in such a manner that each time the sensor organ 44 is pressed down against the plate 36, air is supplied to the pneumatic power means 42, whereby its piston rod 41 performs a stroke in outwards direction thereby actuating the knife 39, so that this knife is carried in under the knife 37 and thus performs a cutting movement. The piston rod 41 is subsequently retracted to the starting position shown in FIG. 7. The retracting movement can take place by air being supplied to the side of the piston facing the piston rod or in its case by means of a spring. The manner described for the control of a pneumatic power means is however well known in the art, and there is a lot of standard equipment available for such a purpose. It is not necessary to provide a more detailed description of the components forming that part of the assembly.

The use of the apparatus for packing and sealing will now be described, reference being made to the steps 4–7 of the foregoing description of the method according to the invention and to FIGS. 4–6.

As is described in connection with step 4, the plastic blank 20 is inserted in the apparatus in the manner illustrated in FIG. 4, the containers 8 being placed in the recesses 23, the female parts being placed in the recesses 24 and the male parts 14 upon the pins 29 of the turned-up handle portion 26-30. The plastic blank 20 is thus folded in an upwards direction, so that the containers will be accessible.

According to step 5 the desired articles are now inserted into the containers. The articles are represented by dashed and dotted lines and are designated 45. As the plastic blank has a plurality of the finished packings several articles or sets of articles can be simultaneously inserted, which facilitates the work and makes possible a logical and simplified insertion procedure even if automatic machines are not used.

According to FIG. 5 and step 6 the cardboard blank 17 is now inserted with its edge 18, forming the edges 16 of the respective cardboard pieces 2, close to the fold 13 of the plastic blank and with its openings 7 placed right in front of the recess 24.

According to FIG. 6 and step 7 the plastic blank is now locked by lowering the handle portion 26-30, whereby the upright portion of the plastic part is folded over the brim portion resting upon the plate 22, the cardboard blank 17 being placed in between. At the end of the downwards movement of the handle portion the male parts 14 are inserted into the female parts 15 and are thereby carried through the openings 7 of the cardboard blank 17. Because of the fact that the recess 24 is somewhat shallower than the height for the male and female parts, a certain compression of the male and female parts takes place in the vertical direction, as shown to some extent in FIG. 6, whereby their sides are slightly bent in an outwards direction, a snap-in action thereby occurring between the two parts. The parts will thus be form-locked to each other, but in spite thereof, they can be separated as a result of the springing property of the sides, which can be moved slightly sideways. The locked packing blank may be extracted from the apparatus after the handle portion has been turned up, so that it is oriented in the position illustrated in FIGS. 4, 5.

The use of the cutting apparatus will now be described, reference being made to step 8 and FIG. 7.

After connection of the cutting apparatus to a source of compressed air, the packing blank is introduced into the opening 33 in an upright condition, until its lower edge strikes against the plate 36 thereby pressing down the sensor organ 44. The knife 39 then performs a cutting stroke in the manner described and the blank is cut off along a dividing line 21 (FIG. 3). The knife 39 then pushes the cut-off part for a short distance under the knife 37, which means that the cut-off part is pushed off from the plate 36, which terminates somewhat inside the cutting edge of the knife 37. The space in the opening 33 thus will be free, and the blank falls down with the cut-off edge striking against the plate 36, whereby, due to the actuation of the sensor organ 44, the knife 39 performs a new stroke, and a new cut-off part is obtained. In this manner the cutting operation is continued, until the whole blank is divided up in packings of the kind shown in FIG. 2.

The packing illustrated in FIG. 2 exhibits all the advantages of a blister pack mentioned in the preamble. Thus, it can be suspended by means of the opening 4 on a fork or a simple bar. As a further advantage the portion of the piece of cardboard 2 located outside of the plastic part 3 can be removed by means of the perforation rule 5. In such an instance it is assumed that at least the essential information on the removed portion is repeated on the remaining portion of the piece of cardboard, by way of example on the side located behind the preferably transparent lower portion 10. If the piece of cardboard 2 is so removed the packings will be suitable for storage in compartments. A label can be torn off from the removed portion by means of the perforation line 6, on which label an identification of the article inserted in the packing can be printed.

In this manner the packing serves the double function of a traditional suspendable blister pack and a packing, which at the same time is suitable for closed or open compartments completed with a label intended for the marking of the compartments. As has been mentioned earlier, a packing is obtained by means of the invention, which is locked in a secure manner but in spite thereof may be opened up, it subsequently being possible to reseal the same in an equally secure manner without any damage occurring to the parts of the packing.

The method of manufacture of the packing and the apparatuses constituting means for carrying out the method in practice provide a very logical operating procedure. It is of special importance that the packing and the blanks can be processed in a logical manner even without the use of automatic machines and even when the packing series are small.

The invention can be modified within the scope of the following claims. Thus, the packing can differ greatly in appearance according to its adaptation to the articles to be packed, and it can also exhibit several containers for separately accommodating several articles which belong together.

Moreover, the blanks for the manufacture of the packings can have other shapes than the ones described.

They shall of course be adapted to the finished packing, but for the rest they can be designed for an optional number of packings accommodated within the same blank. The formation of the parts, which together make up the assembly, can then take place in a different manner than the one shown in FIG. 3 in the form of a row. The apparatuses described have been indicated in a relatively simple form, but within the scope of the invention they can be designed for a more or less automated operation.

We claim:

1. A resealable package, comprising:

a first, transparent member having a receptacle portion with an opening, a brim around the opening of the receptacle portion and structure forming one part of a snap-in lock formed in the brim;

a second, flat member substantially co-extensive with and foldably connected to the transparent member along an edge of the brim opposite the snap-in lock structure, the second member having structure forming the other part of the snap-in lock, the first and second members being thereby detachably connectable, the brim lying flat against the second member when so connected; and, a removable sheet member, of relatively stiff material, interposed fully between the first and second members, and extending from the fold, over the brim and the opening, and past the snap-in lock structure for reinforcing both the receptacle portion and the brim, the removable member having an aperture through which only a portion of only the snap-in lock structure projects, whereby all of said members are held securely but releasably together.

2. The package of claim 1, wherein the snap-in lock structure comprises male and female parts, each disposed on one of said first and second members.

3. The package of claim 2, wherein the male part projects through the aperture in the removable member.

4. The package of claims 2 or 3, wherein the first member bears the female part and the second member bears the male part.

5. The package of claim 1, wherein the first and second members are portions of a common piece of material, the edge being a fold therebetween.

6. The package of claims 1 or 5, wherein a portion of the removable sheet member extends beyond the brim of the receptacle portion, the extending portion having a dividing rule separating and defining the extending portion.

7. The package of claim 6, wherein the dividing rule is located adjacent but beyond the brim of the receptacle portion, whereby the extending portion of the sheet member may be separated from the package.

8. The package of claim 7, further comprising at least one additional dividing rule located in the extending portion of the sheet member, whereby the extending portion can be removed in part.

9. A method for manufacturing a resealable package, for an article of sale and the like, comprising the steps of:

preparing a first, transparent member, having a receptacle portion with an opening, a brim around the opening of the receptacle portion and structure forming one part of a snap-in lock formed in the brim;

preparing a flat second member corresponding in size to the transparent member and having structure forming the other part of the snap-in lock;

foldably connecting the second member to the first, transparent member along an edge of the brim opposite the snap-in lock structure, the first and second members being thereby detachably connectable, the brim lying flat against the second member when so connected;

inserting the article in the receptacle portion;

interposing a removable sheet member, of relatively stiff material, fully between the first and second members, and extending from the fold, over the brim and the opening, and past the snap-in lock structure for reinforcing both the receptacle portion and the brim, the removable member having been provided with an aperture through which only a portion of only the snap-in lock structure may project; and, sealing the package by forcefully folding together the first and second members causing secure engagement of the snap-in lock structure, whereby the first, second and removable members are securely but releasably held together, with the article held in the receptacle portion of the first member, the brim of the first member, the flat second member and the removable sheet member lying in substantially parallel planes, the snap-in lock structure projecting substantially perpendicular to the planes.

10. The method of claim 9, wherein the packages are formed from blanks comprising rows of the first, second and removable members.

11. The method of claim 10, further comprising the step of separating the sealed packages from one another.

12. The method of claims 9 or 10, wherein the first and second members are formed from a common material, the edge being formed by folding the common material.

* * * * *